US005297485A

United States Patent [19]

Bond

[11] Patent Number: 5,297,485

[45] Date of Patent: Mar. 29, 1994

[54] PALLET HAVING ADJUSTABLE LOAD LOCATOR POSTS

[76] Inventor: Irvin D. Bond, 10270 Allen Rd., Clarkston, Mich. 48348

[21] Appl. No.: 5,733

[22] Filed: Jan. 19, 1993

[51] Int. Cl.[5] ..... B65D 19/44

[52] U.S. Cl. ..... 108/55.1; 108/54.1

[58] Field of Search ..... 108/55.1, 55.3, 55.5, 108/51.1, 54.1; 248/670; 292/193

[56] References Cited

U.S. PATENT DOCUMENTS

| | | | |
|---|---|---|---|
| 3,478,995 | 11/1969 | Lantzenhiser | 108/55.5 |
| 4,915,033 | 4/1990 | Bond | 108/55.1 |
| 4,977,836 | 12/1990 | Bond | 108/55.1 |

FOREIGN PATENT DOCUMENTS

| | | | |
|---|---|---|---|
| 0184028 | 11/1982 | Japan | 108/55.3 |
| 0590188 | 1/1978 | U.S.S.R. | 108/55.1 |

*Primary Examiner*—Kenneth J. Dorner
*Assistant Examiner*—Gerald A. Anderson
*Attorney, Agent, or Firm*—Charles W. Chandler

[57] ABSTRACT

A parts stacking pallet is formed by a horizontal base that is constructed to define a number of channel-shaped tracks. Each track adjustably supports an upstanding post, such that the posts can be moved along the tracks adjacent an area defined by a plan configuration of the parts to be stored on the pallet. The posts prevent the stacked parts from being laterally dislocated off the stack. Each post is adjustably clamped to the associated track by a clamping mechanism that includes a shoe located within the track and a manually-operated toggle device that is effective to raise the shoe into pressure engagement with an upper wall of the track. The toggle device includes a swingable handle and a link element that swings through an arc to an overcenter position in which the shoe is firmly clamped to the track. The clamp mechanism is readily operated to the locked or unlocked position. Adjustments are incorporated into the link elements for varying the clamping force.

15 Claims, 3 Drawing Sheets

PALLET HAVING ADJUSTABLE LOAD LOCATOR POSTS

BACKGROUND OF THE INVENTION

This invention relates to a pallet for accurately stacking a plurality of similarly shaped parts one above another, such that a large number of parts can be compactly stored or carried on a single pallet. The invention is especially concerned with a clamping mechanism for securing the posts used for locating the stacked parts on the pallet.

PRIOR ART DEVELOPMENTS

My U.S. Pat. No. 4,915,033, issued on Apr. 10, 1990, shows a pallet construction that includes a flat horizontal base having a series of slots for adjustably supporting a plurality of upstanding posts or pins. The upstanding pins (posts) are arranged on the base in a precise pattern defined by the configuration of the parts that are to be stacked on the pallet. The pins prevent the parts from shifting or moving laterally out of their stacked position.

Typically, the pallet is arranged to receive stampings or flat plates discharged from a forming press or sheet cutting apparatus. The stampings or sheets are deposited onto the pallet to form a stack of similarly configured parts. The locator pins are arranged around the peripheral edges of the stacked parts to prevent individual parts from shifting laterally off the stack.

The locator posts shown in U.S. Pat. No. 4,915,033 are configured as vertical pin structures having cylindrical side surfaces designed to engage the edges of the stacked parts.

My U.S. Pat. No. 4,977,836, issued on Dec. 18, 1990, shows similarly constructed locator pins having cylindrical side surfaces which engage with the edge areas of the stacked parts. With either of these patented locator pin arrangements, there is a possibility that the locator pins will form indentations in the edges of the thin stacked parts.

The present invention contemplates a post construction having a flat side surface presented to the edges of the stacked parts. With such a post configuration, the post engages an extensive edge area on each stacked part, such that it becomes more difficult for the post to gouge or indent the edges of the parts.

In my U.S. Pat. No. 4,915,033 the various parts locator pins (posts) can be shifted laterally along the pallet surface to encircle a range of differently dimensioned stacked parts. Each locator pin comprises a hollow tubular structure and an internal elongated rod. The rod has a threaded upper end connected to an internally threaded conical cap mounted on the upper end of the pin. The lower end of the rod carries a head which exerts a clamping force on the undersurface of the slotted track structure in the pallet base. The user turns the cap with a bar to clamp the pin on the pallet.

The present invention is directed to a locator post structure having a flat side surface contacting the edges of the stacked parts. In order to avoid an extremely bulky or large cross-sectioned locator pin structure, the locator pin is preferably formed as a channel shaped structure rather than as a tubular construction. With a channel type post construction, it is difficult or impractical to use the clamp system shown in either of the above-noted U.S. Pat. Nos. 4,915,033 and 4,977,836.

SUMMARY OF THE INVENTION

The present invention contemplates a pallet for supporting a plurality of similarly shaped parts in a stacked configuration. The pallet has a base having several tracks for supporting a number of upstanding posts. Each post has a flat planar surface presented to the edges of the stacked parts. The posts collectively prevent the stacked parts from shifting laterally out of their stacked position. The flat sides of the posts engage the edges of the parts, to reduce the possibility that heavy side loads exerted by the stacked parts on the posts will gouge or indent in the edges of the parts. The posts are adjustable along the pallet base to accommodate a range of differently sized parts.

Each post is adjustably locked to the pallet base by means of a clamping mechanism that includes a shoe located within a stationary hollow track—constituting part of the pallet base. A handle is pivotally mounted on the post above the shoe. The handle has a toggle-type link means connected to the shoe so that by raising the handle, the shoe is pulled toward the under surface of the track. The clamping mechanism is disengaged from the track by lowering the handle. Raising the handle provides a mechanical advantage enabling the shoe to exert a relatively large clamping force on the track.

The effective length of the link connection between the handle and the clamping shoe can be adjusted as necessary to meet different clamping conditions or to compensate for manufacturing tolerances or in-service wear.

An advantage of the preferred clamp mechanism is that it is easily operated without special tools or equipment. The technician can readily turn the handle to either lock or unlock the locator posts.

THE DRAWINGS

DESCRIPTION OF THE PREFERRED EMBODIMENT OF THE INVENTION

Figure 1:
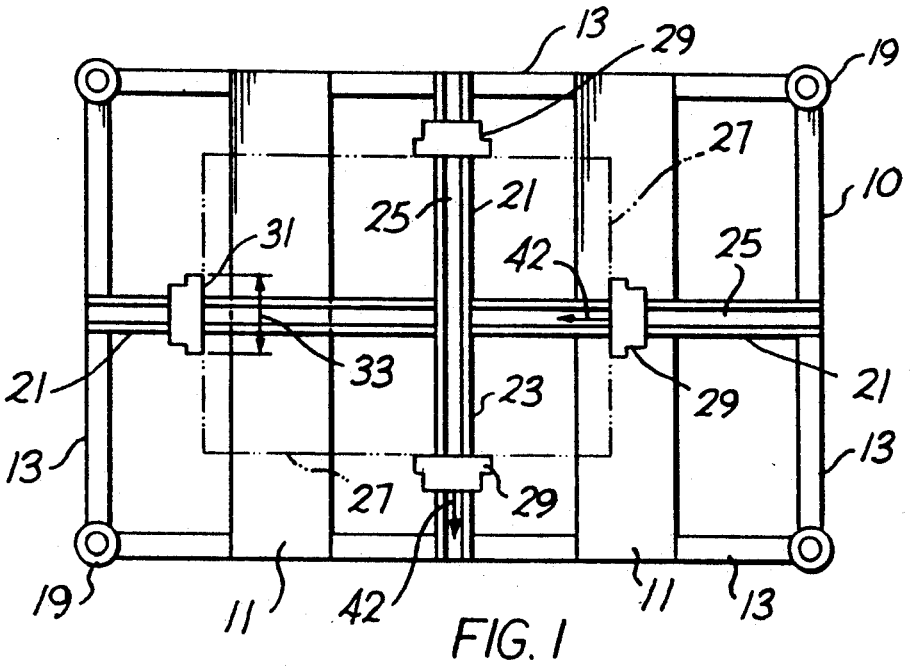
FIG. 1 is a top plan view of a pallet constructed according to the invention.
Figure 2:
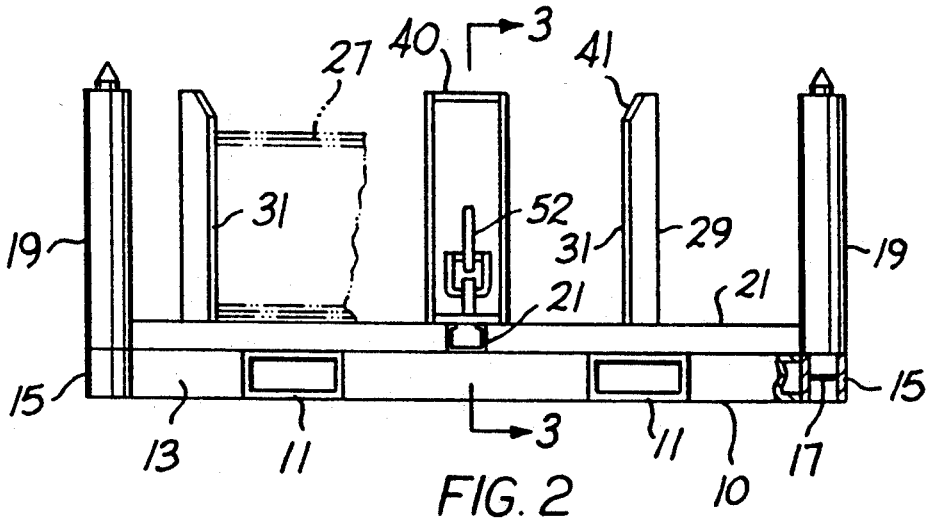
FIG. 2 is an elevational view of the FIG. 1 pallet.

FIGS. 1 and 2 illustrate a parts stacking pallet 10 that comprises two laterally spaced steel tubes 11 welded or otherwise secured to a series of steel frame elements 13. Each frame element 13 preferably is a steel channel oriented with its web wall at the outer edge of the pallet and its flanges extending horizontally inwardly from the web wall. The corners of the pallet are formed by short vertical tubes 15 welded to the associated frame elements 13 to form sockets designed to removably receive the lower ends 17 of corner posts 19. Posts 19 are optional elements used primarily example in the above-mentioned U.S. Pat. Nos. 4,915,033 or 4,977,836.

Steel tubes 11 are spaced by the same distance as the arms (or prongs) on a conventional lift truck. The truck inserts the prongs into tubes 11, in preparation for moving the pallet and its contents to a different location in the factory.

The load-bearing surface of the pallet is defined by four channel-shaped tracks 21 welded to the upper surfaces of tubes 11 and frame elements 13. Additional flooring may be added to enlarge the load-bearing surface. Each track 21 has the channel-shaped cross-section depicted in FIG. 5. Flange walls 23 of each track have spaced, opposed edges forming a horizontal slot 25 extending the length of the track.

As fragmentarily depicted in FIGS. 1 and 2, the load comprises a stack of rectangular steel plates 27 deposited on the pallet in the area circumscribed by four upstanding posts 29. Each post has a flat planar side surface 31 facing the edges of the steel plates so that a substantially length of each edge is in contact (or potential contact) with each post side surface 31. Typically the width dimension 33 of each post side surface 31 is about 8 inches. The height dimension of each post can be about 20 inches. The posts are oriented to mate relatively closely to the outline of the plates (or parts) 27, so that when the plates are individually deposited into the area formed by the posts, the plates will be in near vertical registry with one another, as may be necessary for subsequent handling and processing of the plates.

Figure 3:
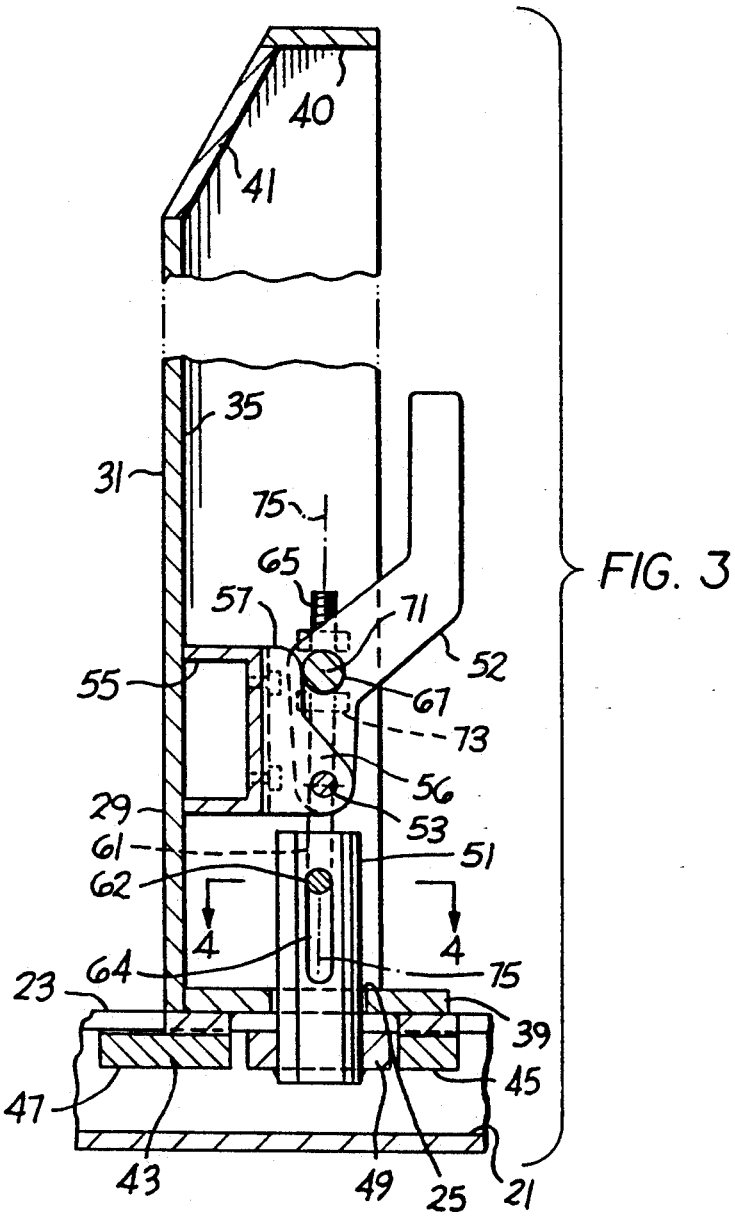
FIG. 3 is a fragmentary enlarged sectional view taken on line 3—3 in 2.
Figure 6:
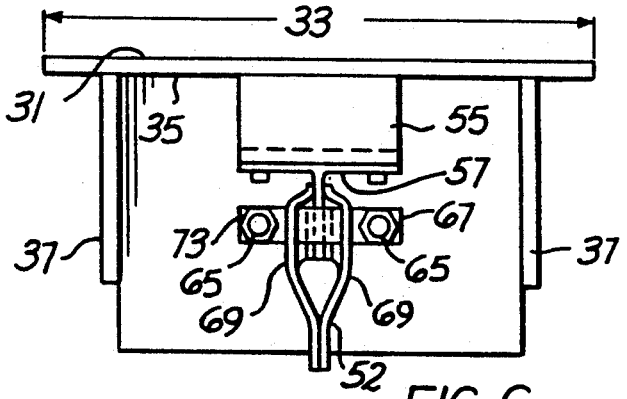
FIG. 6 is transverse sectional view taken on line 6—6 in FIG. 5.
Figure 5:
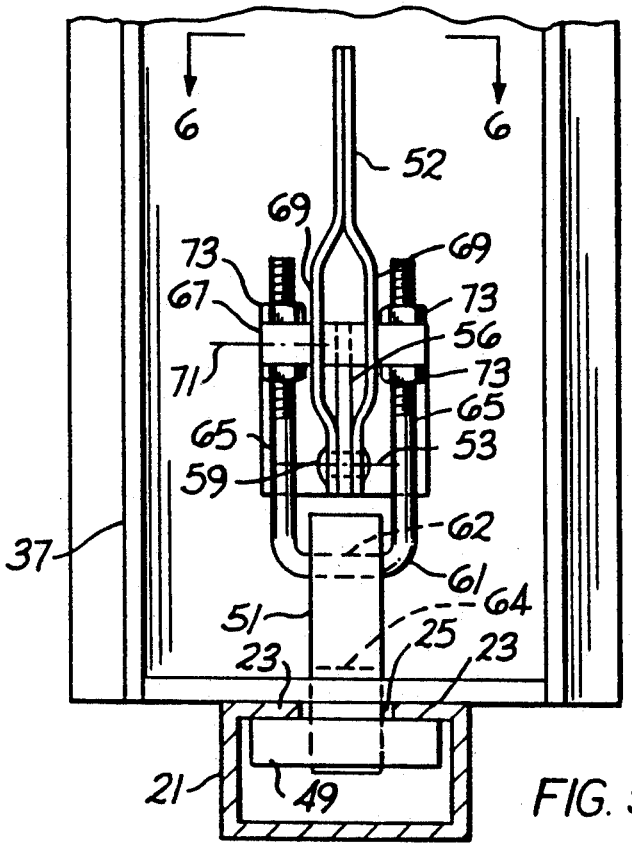
FIG. 5 is a fragmentary right elevational view of the post structure depicted in FIG. 3.

The construction of a representative post 29 is shown in FIGS. 3, 5 and 6. Flat side surface 31 is defined by an upstanding edge abutment wall 35 that is welded at spaced points to two upstanding wing walls 37. A bottom wall 39 spans the space formed by walls 35 and 37 to form a slide surface engageable on track walls 23. The upper end of the post is closed by a rectangular wall 40. A flat guide wall 41 extends angularly and upwardly from wall 35 to guide downwardly moving parts into the area circumscribed by post surfaces 31. The aim is to obtain good vertical registry of the stacked plates without requiring that the individual plates be exactly centered when they are placed onto the pallet. Each post has an angularly inclined guide wall 41 facing the edges of the plates (parts) being deposited onto the pallet.

The various posts 29 are adjustably mounted on tracks 21 so as to be shiftable laterally along the tracks, as indicated by arrows 42 in FIG. 1. Such adjustments are necessary to enable the posts to accommodate a range of differently sized parts. Each post is clamped in a selected stationary position while the parts are being processed, i.e. during the process of being placed on the pallet, or while the pallet containing stacked parts is being transported.

Figure 4:
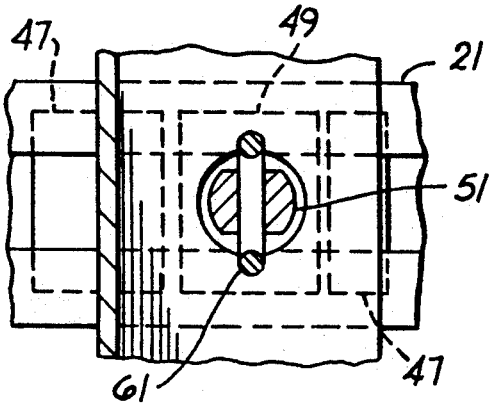
FIG. 4 is a fragmentary sectional view taken on line 4—4 in FIG. 3.

As shown in FIGS. 3 and 4, representative post 29 has two foot members 43 and 45 extending downwardly from the post bottom wall 39 for disposition with the associated hollow track 21. Each foot member includes a relatively narrow neck portion located within track slot 25 and a wider plate portion 47 underlying track walls 23. The foot members guide the post while it is being shifted to different upright positions along the track.

The post has a clamp mechanism for locking the post in selected positions of adjustment. The illustrated clamp mechanism comprises a rectangular shoe 49 welded or otherwise attached to an elongated connector 51. The connector extends upwardly and freely through a circular opening in wall 39. A clamp actuator handle 52 is swingably attached to post 29 for pivotable motion around a horizontal axis 53 located in the area above connector 51. The structural details of the handle mounting mechanism can be varied. As shown in FIGS. 3 and 5, the handle mounting mechanism comprises a channel member 55 affixed to wall 35 of the post, and a bracket 57 secured to the channel by a plurality of screws. The bracket comprises a wall 56 extending away from the channel. Handle 52 has two adhered flat steel straps having end areas engaging opposite faces of wall 56, as shown in FIG. 5. A rivet 59 extends through the handle and wall 56 to form a pivot connection between the handle and the stationary bracket.

Handle 52 is linked to connector 51 via a U-shaped link member 61. The link member comprises a U-shaped rod having a circular cross section. The bight 62 of the U-shaped rod extends transversely through an elongated slot 64 in connector 51. Straight parallel end portions 65 of the U-shaped rod extend through circular holes in a cylindrical pin 67. The pin has a rotary fit within circular openings formed in spaced sections 69 of handle 52. During pivotal motion of the handle around pivot axis 53, cylindrical pin 67 swivels around its own axis 71.

Each straight portion 65 of the U-shaped rod is threaded to receive two nuts 73 located at opposite side surfaces of pin 67. The nuts are selectively threaded along the straight rod sections to incrementally change the effective length of the U-shaped link member, i.e. the distance between bight 62 of the rod and the pin 67 axis. By changing the effective length of the link member, it is possible to change the clamping force of shoe 49 on track walls 23.

FIGS. 3 and 5 show the clamping mechanism clamped to track 21. The straight sections 65 of the U-shaped rod 61 are in tension to exert an upward pulling force on connector 51 and attached shoe 49. The shoe is in clamped engagement with the undersurfaces of track walls 23, such that post 29 is in a stationary position, locked to the horizontal track. In the illustrated position of handle 52, the handle pivot axis 53 is located slightly to the right of an imaginary line 75 extending through the pin 67 axis and the axis of bight 62 (which forms a pivotable connection between the U-shaped rod and connector 51). Handle 52 is designed so that when shoe 49 engages track walls 23, the side surface of cylindrical pin 67 abuts the edge of bracket wall 56, as shown in FIG. 3. The bracket thus limits counterclockwise motion of handle 52 around pivot axis 53.

The clamping mechanism is disengaged from track 21 by manually moving handle 52 around pivot axis 53 in a clockwise direction, as viewed in FIG. 3. Cylindrical pin 67 moves in a circular arc around pivot axis 53, such that the bight 62 of link member 61 slides downwardly in slot 64 of connector 51. Shoe 49 thus falls away from the undersurface of track walls 23.

Slot 64 is a structural feature used primarily to assemble U-shaped rod 61 to connector 51. With connector 51 extending upwardly through the opening in wall 39, the U-shaped rod can be manipulated through slot 64 to allow the straight portions 65 of the rod to then be inserted through the transverse holes in circular pin 67. Nuts 73 are threaded onto rod portions 65 after the U-shaped rod has been connected to connector 51. By making the link member 61 as a multi-piece component, it would be possible to eliminate slot 64 in favor of a single transverse circular hole extending through connector 51.

The clamping pressure of shoe 49 on track walls 23 is related to the effective length of link member 61, i.e. the distance between the axis of bight 62 and the axis of pin 67. An elongated (lengthened) link member will reduce the clamping force, whereas a shortened link member will increase the clamping force. The effective length of the link member can be incrementally changed by turning nuts 73 along the lengths of rod sections 65. The nuts are preferably adjusted while the clamp mechanism is in a relaxed condition, disengaged from track walls 23.

The link member length can be adjusted to compensate for manufacturing tolerances and in-service wear of the clamp components. Relatively high forces can he achieved, with rod sections 65 being under relatively high tension loads when handle 52 is in its raised position (FIG. 3).

As previously noted, the clamping mechanism is operated by raising or lowering handle 52, without using special tools.

Referring to FIG. 3, note that foot member 43 extends leftwardly beyond the plane of post side surface 31. The stacked parts 27 act downwardly on track walls 23, such that walls 23 deflect downwardly to a slight extent (due to the weight of the stacked parts). Such downward deflection of track walls 23 produces a frictional interlock between walls 23 and foot member 43, thus augmenting the post locking action of clamping shoe 49. In the preferred practice of the invention, foot member 43 extends laterally beyond the post side surface (as shown in FIG. 4) so as to underlie the stacked parts.

Figure 7:
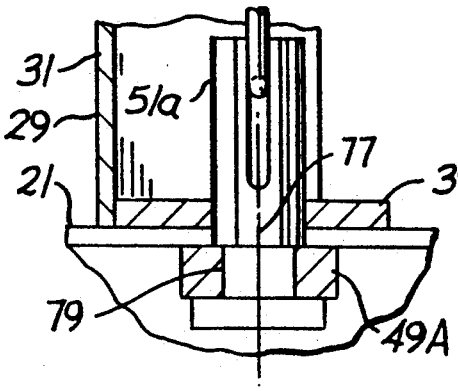
FIG. 7 is a fragmentary sectional view of an alternative structure detail that can be used in the post structure of FIG. 3.

As viewed in FIG. 1, each post 29 has its flat side surface 31 abutting the edges of the stacked parts (plates) 27. The posts are not rotatable so that side surfaces 31 are essentially in a vertical plane extending normal to track 21 (as viewed in FIG. 1). In some situations, the stacked parts may have irregular contours such that the edges of the stacked parts may not contact post side surfaces 31. To achieve a desired facial engagement of the post side surfaces 31 with the edges of the stacked parts in such situations, the post clamp mechanism can be modified to permit a rotary adjustment of the post. FIG. 7 fragmentarily shows a modified clamping mechanism designed to permit rotary adjustment of the post around the axis 77 of connector 51A.

Shoe 49A has a rotary fit on the circular section 79 of connector 51A. The post 29 is rotated around vertical axis 77 without disturbing the relationship between shoe 49A and track 21. The clamp actuator handle (not visible in FIG. 7) can be operated when post 29 is in a desired position of rotary adjustment, wherein the plane of side surface 31 of the post has a desired alignment relative to the edge surface of the stacked parts. The clamping mechanism, fragmentarily shown in FIG. 7, is designed to maintain a desired clamping action on the track while accommodating the post to irregularly shaped parts having edges acutely angled to the post-supported tracks.

Figure 8:
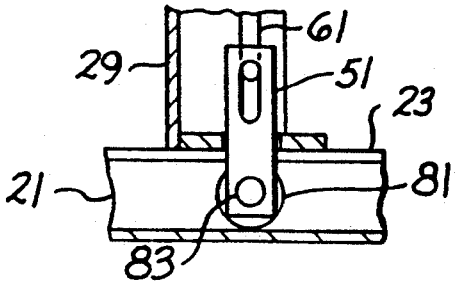
FIG. 8 is a fragmentary view of an alternative clamp shoe construction that can be used in the FIG. 3 post structure.

FIG. 8 fragmentarily shows a variant of the invention, wherein the clamping shoe is formed by two rollers 81 mounted on an axle 83 that extends transversely through the lower end of connector 51. Only one of the rollers is visible in FIG. 8. During adjustment of the post 29 along track 21, rollers 81 roll along the undersurfaces of track walls 23. When the clamp actuator handle is raised, connector 51 is drawn upwardly so that the circular edge surfaces of rollers 81 exert a clamping pressure on track walls 23. In major respects the roller-type shoes 81 of FIG. 8 operate in the same fashion as the plate-type shoe 49 of FIGS. 3 and 5.

The posts are sufficiently rigid so that the pallets can be stacked by placing a second pallet on horizontal walls 40 on the upper ends of the posts. The arrangement places the load of an upper stacked pallet closer to the vertical supports of a lower pallet than an arrangement where a pallet is placed only on corner posts.

The drawings necessarily show specific forms of the invention. However, it will be appreciated that the invention can be practiced in other structural forms and configurations.

Having described my invention, I claim:

1. A pallet for supporting a plurality of similarly shaped parts piled one above the other in a stacked condition, said parts having a common edge orientation when in the stacked condition; said pallet comprising:

a base that comprises a plural number of elongated hollow tracks, each track comprising an upper horizontal flat wall having a slot therein;

a plural number of vertical posts supported on said base, each post having a lower end seated against one of said tracks and an upper end elevated above said base, said posts being horizontally adjustable along the associated tracks, whereby the posts can be shifted along the tracks to engage the edges of differently sized stacked parts so as to prevent dislocation of the parts from the stack; and a clamp mechanism carried by each post for releasably clamping said post to the associated track; each clamp mechanism comprising a shoe located within the associated track, an elongated connector extending upwardly from the shoe through the track slot, a manual handle pivotally mounted on the post in the space above said connector, and a link trained between the handle and the connector, whereby upward swinging of the handle around its pivotal mounting causes the link to exert an upward pulling force on the elongated connector, such that said shoe comes into pressure engagement with the upper horizontal wall of the track.

2. The pallet of claim 1, wherein each post comprises an upstanding flat abutment wall adapted to engage edge areas of the stacked abutment wall parts, said upstanding wall having side edges spaced a considerable distance apart, whereby said upstanding wall has an extensive surface area in contact with the stacked parts.

3. The pallet of claim 2, wherein each post further comprises two upstanding wing walls extending right angularly from said upstanding abutment wall, whereby the post has a channel-shaped cross section.

4. The pallet of claim 3, wherein each post has a bottom wall spanning the two wing walls at the lower end thereof, said bottom wall having an opening therein accommodating said elongated connector, said post bottom wall having an extensive area thereof in facial contact with the upper horizontal wall of the associated track, such that the post bottom wall and subjacent shoe cooperatively exert a clamping force on the intervening wall of the track.

5. The pallet of claim 1, and further comprising a foot member carried by each of said posts within the associated hollow track, said foot member extending laterally from the post so as to underlie the stack of parts having edge engagement with the post, said foot member being slidably engaged with the upper wall of the track so that slight downward deflection of the track upper wall by the stacked parts loading will produce a frictional interlock between the foot member and the track upper wall.

6. The pallet of claim 1, wherein said link means has means thereon for changing the link means effective length, to change the upward stroke of the connector for a given swing motion of the handle.

7. The pallet of claim 6, wherein said link means comprises a U-shaped rod member having two parallel threaded rod sections, said handle comprising a horizontal cylindrical pin extending parallel to the handle pivot axis, said pin having two spaced holes extending therethrough for accommodating said threaded rod sections, and two nuts carried on each threaded rod section at opposite side surfaces of the pin, whereby said nuts can be selectively adjusted on the associated rod sections to incrementally adjust the position of the U-shaped rod member relative to the pin.

8. The pallet of claim 7, wherein said handle comprises two flat straps having spaced sections thereof, two aligned circular holes in the spaced strap sections, said pin extending freely through the circular holes in said spaced strap sections so that during swinging motion of the handle around its pivotable mounting, the pin can rotate around its axis, whereby the U-shaped rod member can change its angle with respect to the handle.

9. The pallet of claim 1, wherein said elongated connector comprises a vertical bar located on the central axis of said shoe; said link means having a first pivotal connection with said vertical bar and a second pivotal connection with the handle; and a third pivotal connection between the handle and the post, said third pivotal connection being located so that during upward swinging motion of the handle, an imaginary line joining the first and second pivotal connections passes through said third pivotal connection.

10. The pallet of claim 9, wherein said link means comprises a U-shaped rod having a bight portion extending transversely through said vertical pin.

11. The pallet of claim 10, wherein said second pivotal connection comprises a rotary circular pin extending transversely through the handle; said circular pin having two holes extending therethrough at spaced points therealong; said U-shaped rod having two spaced parallel rod sections extending through the holes in said circular pin.

12. The pallet of claim 11, and further comprising two nuts threaded on each one of said parallel rod sections to engage opposite side surfaces of the circular pin; said nuts being turnable to incrementally move the rod sections through the circular holes in the pin, thereby adjusting the effective length of the link means.

13. The pallet of claim 1, wherein each post comprises an upstanding flat abutment wall and a flat guide wall presentable to edge areas of the stacked parts; said flat abutment wall extending vertically from the lower end of the post to a point in near proximity to the post upper end; said flat guide wall extending angularly and upwardly from the upper limit of the abutment wall to the upper end of the post, whereby individual parts being deposited onto the stack of parts can be guided into vertical registry with parts already in the stack.

14. A locator post assembly, for use with a pallet having a base adapted to support stacks of differentially sized parts, comprising:

a plurality of vertical posts suited to be supported on a pallet base having a plurality of elongated hollow tracks, each track comprising an upper horizontal flat wall having a slot therein, each post having a lower end seated against one of said tracks and an upper end elevated above said base, said posts being horizontally adjustable along the associated tracks, whereby the posts can be shifted along the tracks to engage the edges of differently sized stacked parts to prevent dislocation of the parts from the stack; and a clamp mechanism carried by each post for releasably clamping the post to the associated track, each clamp mechanism comprising a shoe adapted to be located within the associated track, an elongated connector extending upwardly from the shoe through the track slot, a manual handle pivotally mounted on the post above said connector, and a link trained between the handle and the connector, whereby upward swinging of the handle around its pivotal mounting causes the link to exert an upward pulling force on the elongated connector, such that the shoe comes into pressure engagement with a upper horizontal wall of the track.

15. The combination of claim 14, in which the vertical posts each having an upper horizontal surface for receiving and supporting the base of a second pallet stacked above the first mentioned pallet.

* * * * *